US010651614B1

(12) United States Patent
Sun et al.

(10) Patent No.: US 10,651,614 B1
(45) Date of Patent: May 12, 2020

(54) PLUG CONNECTOR

(71) Applicant: Cheng Uei Precision Industry Co., LTD., New Taipei (TW)

(72) Inventors: Yang-Yang Sun, Dong-Guan (CN); Ming-Wei Lee, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/517,548

(22) Filed: Jul. 20, 2019

(30) Foreign Application Priority Data

Mar. 21, 2019 (CN) ..... 2019 2 0367641 U

(51) Int. Cl.

| | |
|---|---|
| ***H01R 12/00*** | (2006.01) |
| ***H01R 24/60*** | (2011.01) |
| ***H01R 4/02*** | (2006.01) |
| ***H01R 13/502*** | (2006.01) |
| ***H01R 13/516*** | (2006.01) |
| ***H01R 13/42*** | (2006.01) |
| ***H01R 13/514*** | (2006.01) |

(52) U.S. Cl.
CPC ..... *H01R 24/60* (2013.01); *H01R 4/02* (2013.01); *H01R 13/42* (2013.01); *H01R 13/502* (2013.01); *H01R 13/514* (2013.01); *H01R 13/516* (2013.01)

(58) Field of Classification Search
CPC ..... H01R 4/02; H01R 24/60; H01R 13/42; H01R 13/502; H01R 13/514; H01R 13/516
USPC ..... 439/76.1, 660
See application file for complete search history.

(56) References Cited

U.S. PATENT DOCUMENTS

| | | | | |
|---|---|---|---|---|
| 8,033,868 | B2 * | 10/2011 | Wang | H01R 24/60 439/660 |
| 8,777,666 | B2 * | 7/2014 | Golko | H01R 13/6594 439/607.34 |
| 8,794,981 | B1 * | 8/2014 | Rodriguez | H01R 13/405 439/76.1 |
| 9,768,568 | B1 * | 9/2017 | Jin | H01R 24/60 |
| 10,050,365 | B1 * | 8/2018 | Ju | H01R 13/516 |

* cited by examiner

*Primary Examiner* — Khiem M Nguyen
(74) *Attorney, Agent, or Firm* — Cheng-Ju Chiang

(57) ABSTRACT

A plug connector includes a main body, a protecting assembly and an outer shell. The main body includes a connecting element for an electrical connection, a circuit board electrically connected with the connecting element, a soldering element fastened to a rear end of the circuit board, and an inner shell surrounding the circuit board. The protecting assembly is fastened to the main body. The protecting assembly includes a combination element surrounding the inner shell, and a protecting element fastened with the combination element. The outer shell surrounds the inner shell. The protecting element is fastened to a junction among the connecting element, the inner shell and the outer shell. The combination element has a first buckling assembly and a second buckling assembly. The first buckling assembly is buckled with the inner shell. The second buckling assembly is buckled with the outer shell.

10 Claims, 6 Drawing Sheets

PLUG CONNECTOR

CROSS-REFERENCE TO RELATED APPLICATION

The present application is based on, and claims priority from, China Patent Application No. 201920367641.9, filed Mar. 21, 2019, the disclosure of which is hereby incorporated by reference herein in its entirety.

BACKGROUND OF THE INVENTION

1. Field of the Invention

The present invention generally relates to a connector, and more particularly to a plug connector capable of effectively fastening a protecting element thereof, and simplifying a manufacturing process and manufacturing procedures thereof.

2. The Related Art

Generally, a conventional plug connector includes a connecting element, and an outer shell fastened to the connecting element. The outer shell is made of a harder material. When the conventional plug connector is inserted into a docking port, because the outer shell is made of the harder material, the outer shell of the conventional plug connector easily scratches or abrades an outer cover of the electronic product to which the conventional plug connector is assembled, consequently, an aesthetic feeling of an appearance of the conventional plug connector is affected. So, the conventional plug connector further includes a protecting element made of a silicone material, the outer shell of the conventional plug connector is isolated from the outer cover of the electronic product by virtue of the protecting element. Thereby the outer cover of the electronic product is prevented from being scratched or abraded.

However, in order to ensure that the protecting element is capable of being connected with and fastened with the plug connector, in the conventional plug connector, the protecting element is fastened to a junction between the connecting element and the outer shell, accordingly an interstice is formed between the protecting element and the outer shell and a manufacturing process of the conventional plug connector is hardly controlled. Thus the conventional plug connector is incapable of effectively fastening the protecting element thereof, and complicating a manufacturing process and manufacturing procedures thereof.

SUMMARY OF THE INVENTION

An object of the present invention is to provide a plug connector. The plug connector includes a main body, an integrally molded protecting assembly and an outer shell. The main body includes a connecting element for an electrical connection, a circuit board electrically connected with the connecting element, a soldering element soldered to and fastened to a rear end of the circuit board, and an inner shell fastened between the connecting element and the soldering element. The inner shell surrounds the circuit board. The protecting assembly is fastened to a front end of the main body. The protecting assembly includes a combination element surrounding a front of a peripheral surface of the inner shell, and a protecting element fastened with a front end of the combination element and mounted around the front of the peripheral surface of the inner shell. The outer shell which is integrally molded, surrounds the inner shell. The protecting element is fastened to a junction among the connecting element, the inner shell and the outer shell. The combination element has a first buckling assembly and a second buckling assembly disposed to two opposite ends of the combination element facing the protecting element and the outer shell, respectively. The first buckling assembly is buckled with the front of the peripheral surface of the inner shell. The second buckling assembly is buckled with an inner peripheral surface of the outer shell.

Another object of the present invention is to provide a plug connector. The plug connector includes a main body, a combination element, a protecting element, and an outer shell surrounding the inner shell. The main body includes a connecting element, a circuit board electrically connected with the connecting element, a soldering element soldered to a rear end of the circuit board, and an inner shell surrounding the circuit board. The combination element surrounds the inner shell. The protecting element is integrally molded with a front end of the combination element and mounted around the inner shell. The outer shell surrounds the inner shell. The protecting element is fastened to a junction among the connecting element, the inner shell and the outer shell. The combination element has a first buckling assembly and a second buckling assembly disposed to two opposite ends of the combination element facing the protecting element and the outer shell, respectively. The first buckling assembly is buckled with the front of the peripheral surface of the inner shell. The second buckling assembly is buckled with an inner peripheral surface of the outer shell.

Another object of the present invention is to provide a plug connector. The plug connector includes a connecting element, a circuit board electrically connected with the connecting element, a soldering element soldered to the circuit board, an inner shell surrounding the circuit board, a combination element surrounding a front of a peripheral surface of the inner shell, a protecting element integrally molded with a front end of the combination element and mounted around the front of the peripheral surface of the inner shell, and an integrally molded outer shell surrounding the inner shell. The protecting element is fastened to a junction among the connecting element, the inner shell and the outer shell. The combination element has a first buckling assembly and a second buckling assembly disposed to two opposite ends of the combination element facing the protecting element and the outer shell, respectively. The first buckling assembly is buckled with the front of the peripheral surface of the inner shell. The second buckling assembly is buckled with an inner peripheral surface of the outer shell.

As described above, the protecting element of the plug connector is integrally molded to the combination element by an injection molding technology. The protecting element is fastened between the inner shell and the outer shell by virtue of the first buckling assembly and the second buckling assembly, so that the protecting element is fastened to the junction among the connecting element, the inner shell and the outer shell, and a product stability of the plug connector. As a result, the plug connector is capable of effectively fastening the protecting element to the plug connector, and the plug connector simplifies a manufacturing process and manufacturing procedures thereof.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
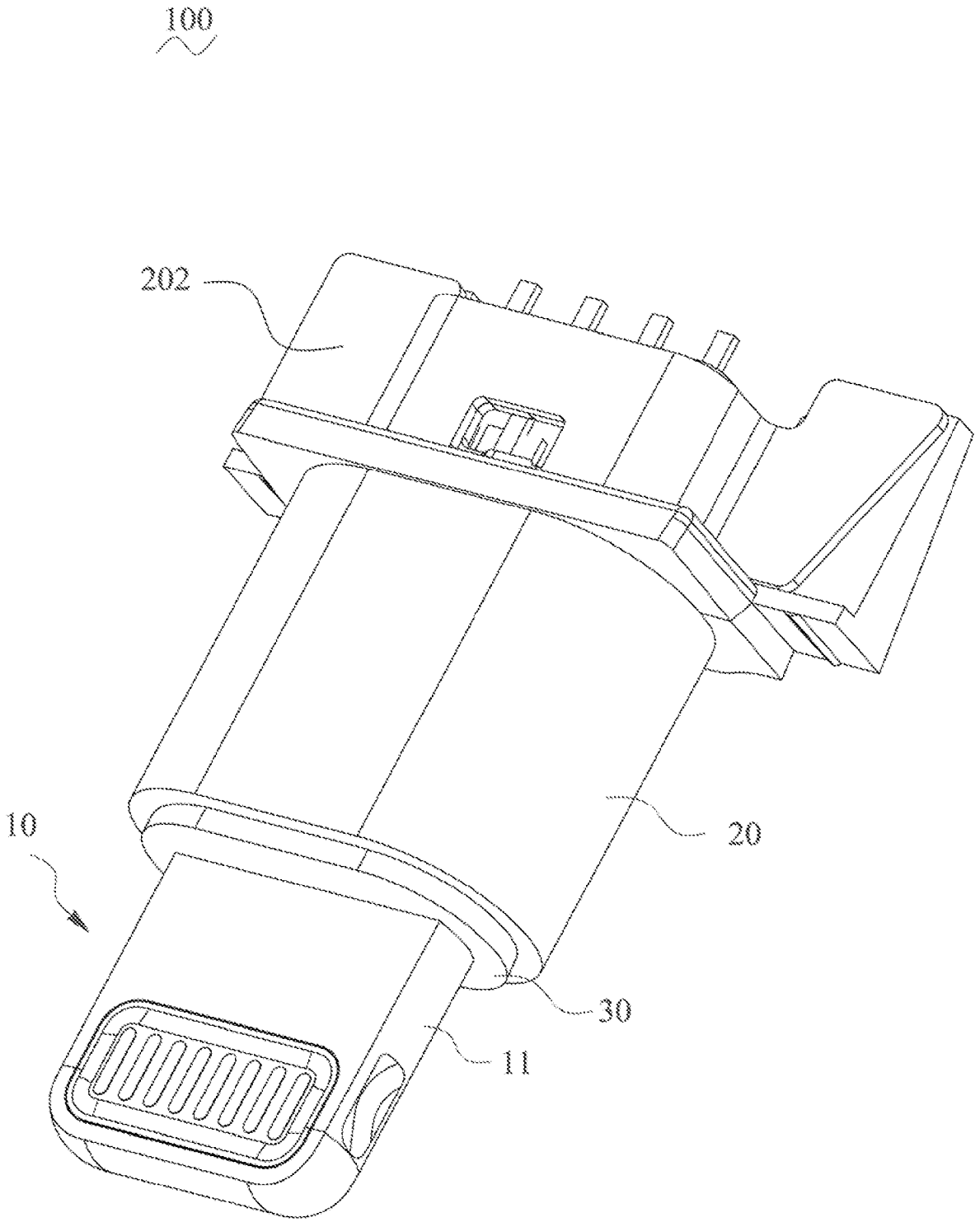
FIG. 1 is a perspective view of a plug connector in accordance with a preferred embodiment of the present invention.
Figure 2:
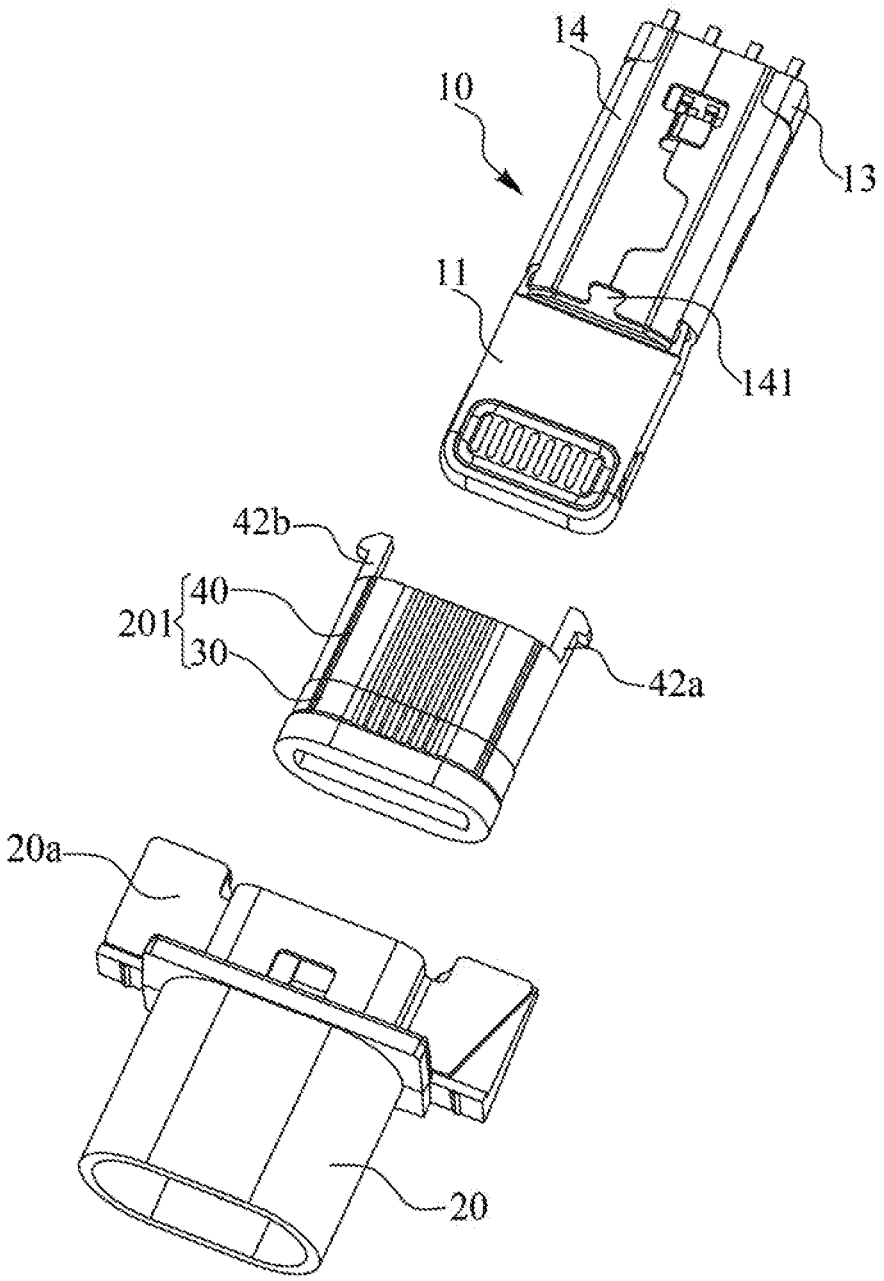
FIG. 2 is a partially exploded perspective view of the plug connector of FIG. 1.
Figure 4:
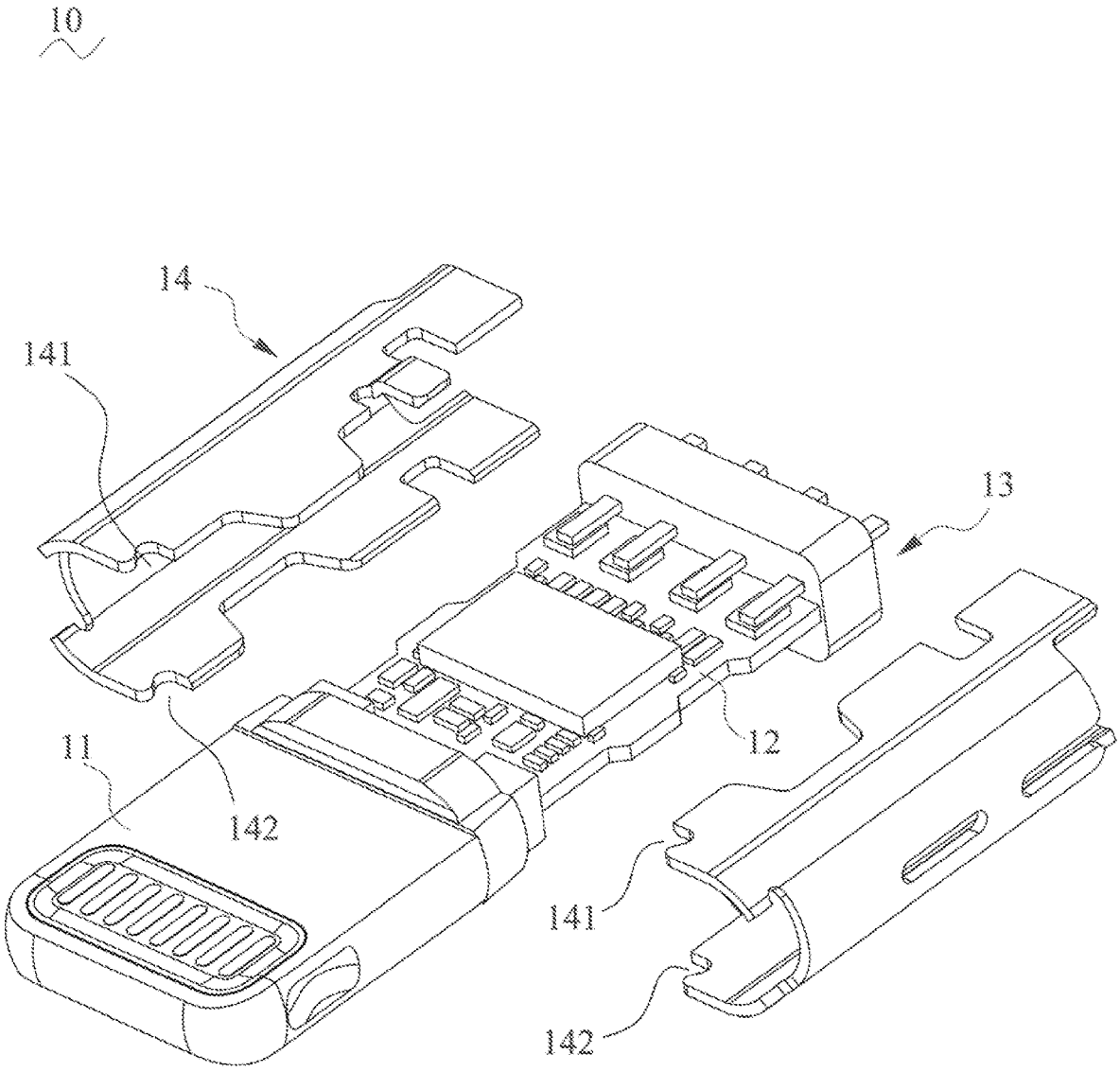
FIG. 4 is a partially exploded schematic diagram of a main body of the plug connector of FIG. 1.
Figure 5:
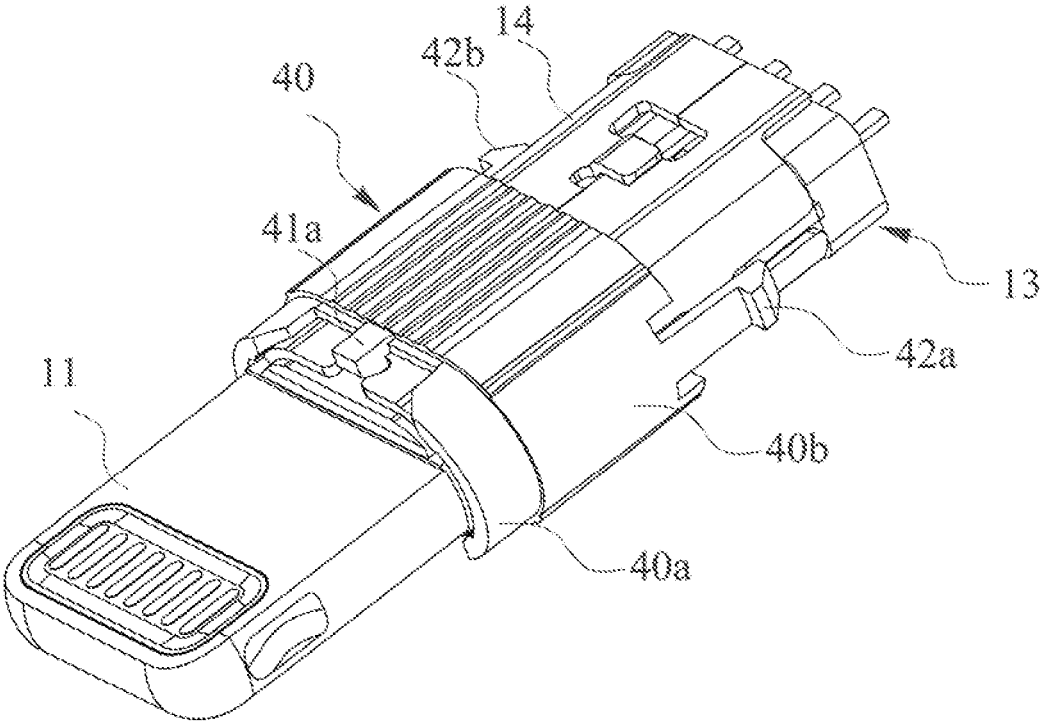
FIG. 5 is a partially perspective view of the plug connector of FIG. 1, wherein the main body is combined with a protecting assembly.
Figure 6:
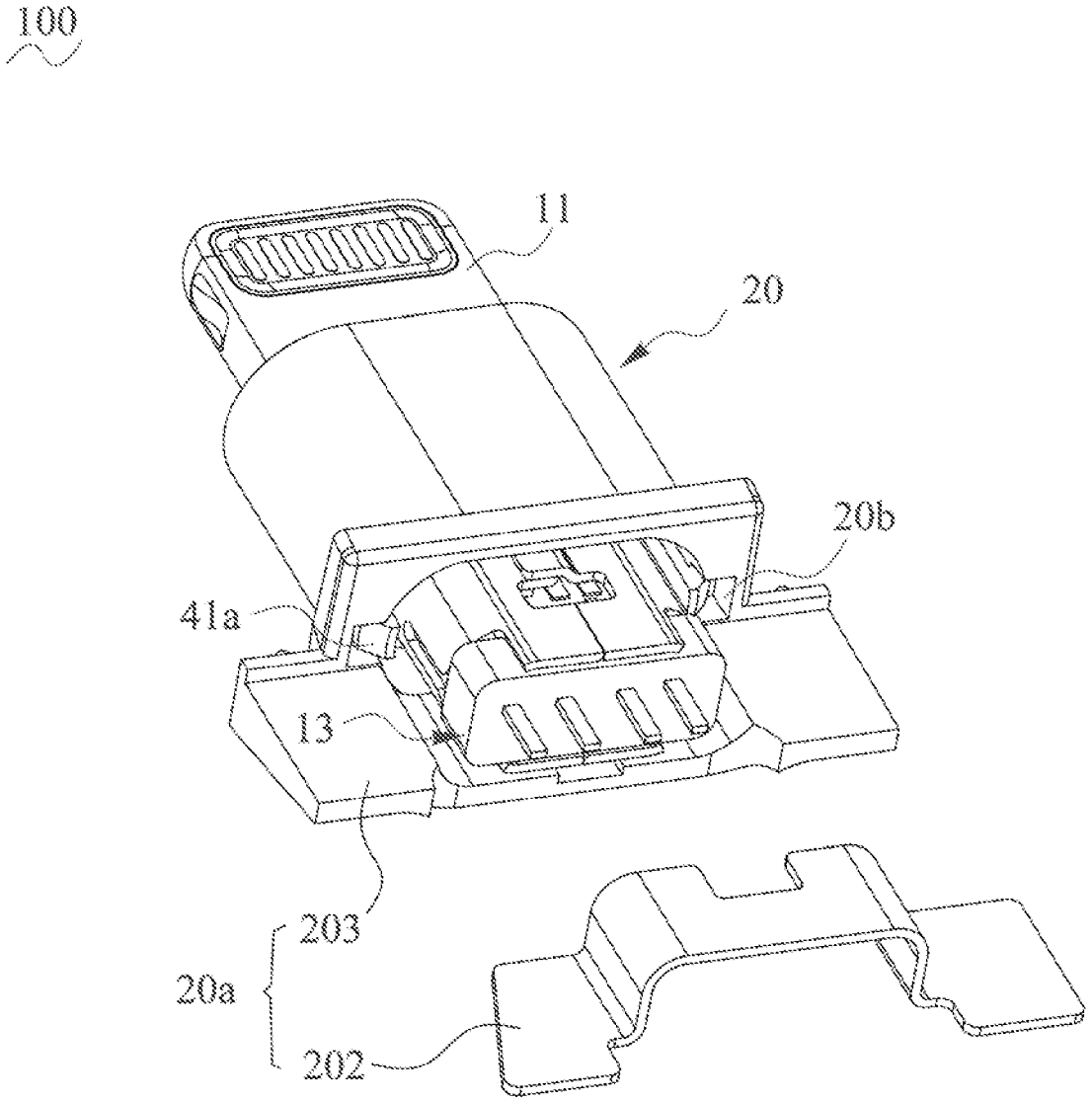
FIG. 6 is a partially exploded schematic diagram of the plug connector of FIG. 1, wherein a propping element is separated from the main body, the protecting assembly and an outer shell of the plug connector of FIG. 1.

With reference to FIG. 1, FIG. 2 and FIG. 4, a plug connector 100 in accordance with a preferred embodiment of the present invention is shown. The plug connector 100 includes a main body 10, an integrally molded protecting assembly 201 fastened to a front end of the main body 10, an outer shell 20 which is integrally molded, and a propping element 202. The protecting assembly 201 includes a protecting element 30 and a combination element 40.

Referring to FIG. 1 to FIG. 4, the main body 10 includes a connecting element 11, a circuit board 12, a soldering element 13 and an inner shell 14. The inner shell 14 has a location function. The connecting element 11 is used for an electrical connection. The circuit board 12 is electrically connected with the connecting element 11. The soldering element 13 is soldered to and fastened to a rear end of the circuit board 12. The inner shell 14 is fastened between the connecting element 11 and the soldering element 13. The inner shell 14 surrounds the circuit board 12. A front end of the inner shell 14 is welded to a top surface and a bottom surface of a rear end of the connecting element 11. A rear end of the inner shell 14 is welded to a periphery surface of a middle of the soldering element 13. A middle of a front edge of a top of the inner shell 14 is recessed rearward to form a first recess 141. A middle of a front edge of a bottom of the inner shell 14 is recessed rearward to form a second recess 142.

Figure 3:
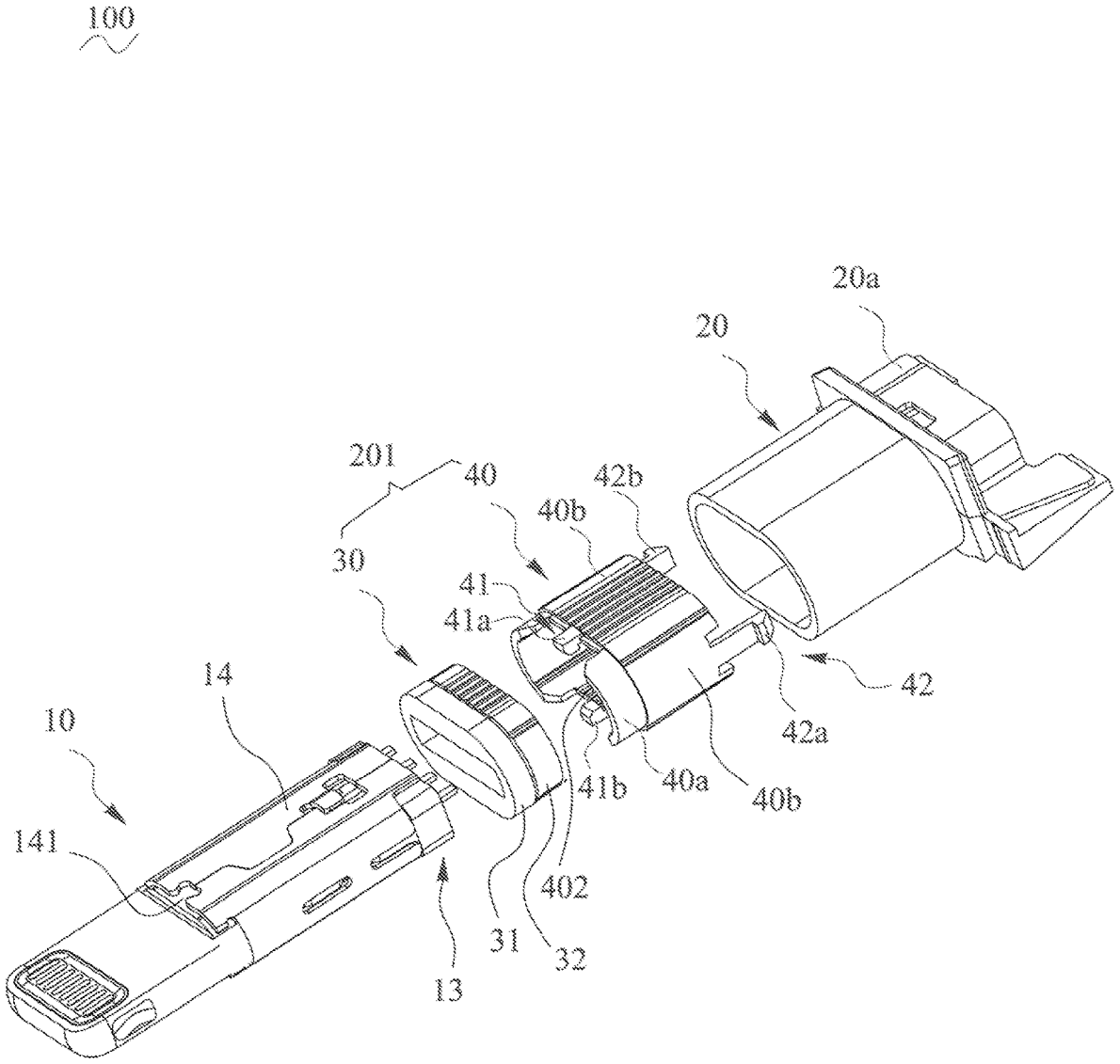
FIG. 3 is another partially exploded perspective view of the plug connector of FIG. 1.

Referring to FIG. 1 to FIG. 3, the protecting element 30 is fastened with and is integrally molded with a front end of the combination element 40 to form the protecting assembly 201, and the protecting element 30 is mounted around a front of a peripheral surface of the inner shell 14. The protecting element 30 has a hollow first frame 31, and a hollow second frame 32 protruded rearward from a middle of a rear surface of the first frame 31. A middle of the first frame 31 is corresponding to and communicated with a middle of the second frame 32. The combination element 40 is of a hollow shape. The combination element 40 includes a connecting end 40*a* and a base portion 40*b*. The connecting end 40*a* is connected with a front end of the base portion 40*b*. The connecting end 40*a* is disposed to the front end of the inner shell 14 connected with one end of the connecting element 11. The connecting end 40*a* is connected with the protecting element 30. The second frame 32 is inserted into a middle of the combination element 40. The connecting end 40*a* and the base portion 40*b* are integrally molded. The combination element 40 surrounds the front of the peripheral surface of the inner shell 14.

Referring to FIG. 1 to FIG. 6, the combination element 40 is clamped and fastened between the inner shell 14 and the outer shell 20. The combination element 40 has a first buckling assembly 41 and a second buckling assembly 42 disposed to two opposite ends of the combination element 40 facing the protecting element 30 and the outer shell 20, respectively. The first buckling assembly 41 is buckled with the front of the peripheral surface of the inner shell 14. The second buckling assembly 42 is buckled with an inner peripheral surface of the outer shell 20. The first buckling assembly 41 is disposed to the connecting end 40*a*. The first buckling assembly 41 includes an upper buckling portion 41*a* protruded from and projecting beyond a top of the connecting end 40*a*, and a lower buckling portion 41*b* protruded from and projecting beyond a bottom of the connecting end 40*a*. The upper buckling portion 41*a* and the lower buckling portion 41*b* are buckled with the front end of the inner shell 14 connected with one end of the connecting element 11. A top and a bottom of the connecting end 40*a* are opened freely to form a first lacking groove 401 and a second lacking groove 402. A rear wall of the first lacking groove 401 extends frontward and protrudes downward to form the upper buckling portion 41*a*. A rear wall of the second lacking groove 402 extends frontward and protrudes upward to form the lower buckling portion 41*b*. The upper buckling portion 41*a* is buckled in the first recess 141. The lower buckling portion 41*b* is buckled in the second recess 142. The first buckling assembly 41 is buckled to and fastened to the front end of the inner shell 14 adjacent to the connecting element 11.

The second buckling assembly 42 is disposed to one end of the base portion 40*b* adjacent to the soldering element 13. Two opposite sides of the base portion 40*b* extend rearward and then protrude oppositely to form a first lateral buckling portion 42*a* and a second lateral buckling portion 42*b*, respectively. The first lateral buckling portion 42*a* and the second lateral buckling portion 42*b* are disposed to a left side and a right side of the base portion 40*b*. The second buckling assembly 42 includes the first lateral buckling portion 42*a* and the second lateral buckling portion 42*b*. The first lateral buckling portion 42*a* and the second lateral buckling portion 42*b* project beyond a rear surface of the base portion 40*b*. The outer shell 20 is of a hollow barrel shape. Inner surfaces of two opposite sides of a rear end of the outer shell 20 adjacent to the soldering element 13 are recessed oppositely to form two buckling grooves 20*b* penetrating through rear surfaces of the two opposite sides of the rear end of the outer shell 20, respectively. The two buckling grooves 20*b* are matched with the first lateral buckling portion 42*a* and the second lateral buckling portion 42*b*, respectively. The first lateral buckling portion 42*a* and the second lateral buckling portion 42*b* are buckled in the two buckling grooves 20*b*, respectively. The combination element 40 is buckled with and fastened with the outer shell 20 by virtue of the second buckling assembly 42 being cooperated with and assembled with the two buckling grooves 20*b*.

In the preferred embodiment, in order to make the protecting element 30 fastened to a junction among the connecting element 11, the inner shell 14 and the outer shell 20, the integrally molded outer shell 20 surrounds the front of the peripheral surface of the inner shell 14 and the combination element 40. The outer shell 20 includes a covering portion 203 disposed at a rear end of the outer shell 20. The covering portion 203 is disposed to one end of the outer shell 20, and covers a bottom of the soldering element 13. The protecting element 30 is disposed to a junction among the connecting element 11, the inner shell 14 and the outer shell 20. The propping element 202 is mounted to the rear end of the outer shell 20. The propping element 202 cooperates with the covering portion 203 of the outer shell 20 to form a surrounding barrel 20*a* for being combined with and fastened with an electronic product (not shown). The surrounding barrel 20*a* surrounds the soldering element 13.

In order to simplify a manufacturing process and manufacturing procedures of the plug connector 100 to ensure a stability of the plug connector 100, the protecting element 30 is made of a silicone material, the combination element 40 is made of a plastic material, and the protecting element 30 is integrally molded to the combination element 40 by an injection molding technology. The protecting element 30 is fastened between the inner shell 14 and the outer shell 20 by virtue of the first buckling assembly 41 and a second buckling assembly 42, so that the protecting element 30 is fastened to the junction among the connecting element 11, the inner shell 14 and the outer shell 20.

As described above, the protecting element 30 of the plug connector 100 is integrally molded to the combination element 40 by the injection molding technology. The protecting element 30 is fastened between the inner shell 14 and the outer shell 20 by virtue of the first buckling assembly 41 and the second buckling assembly 42, so that the protecting element 30 is fastened to the junction among the connecting element 11, the inner shell 14 and the outer shell 20, and a product stability of the plug connector 100. As a result, the plug connector 100 is capable of effectively fastening the protecting element 30 to the plug connector 100, and the plug connector 100 simplifies a manufacturing process and manufacturing procedures thereof

What is claimed is:

1. A plug connector, comprising:

a main body including a connecting element for an electrical connection, a circuit board electrically connected with the connecting element, a soldering element soldered to and fastened to a rear end of the circuit board, and an inner shell fastened between the connecting element and the soldering element, the inner shell surrounding the circuit board;

an integrally molded protecting assembly fastened to a front end of the main body, the protecting assembly including a combination element surrounding a front of a peripheral surface of the inner shell, and a protecting element fastened with a front end of the combination element and mounted around the front of the peripheral surface of the inner shell; and an outer shell which is integrally molded, surrounding the inner shell, the protecting element fastened to a junction among the connecting element, the inner shell and the outer shell, the combination element having a first buckling assembly and a second buckling assembly disposed to two opposite ends of the combination element facing the protecting element and the outer shell, respectively, the first buckling assembly being buckled with the front of the peripheral surface of the inner shell, the second buckling assembly being buckled with an inner peripheral surface of the outer shell.

2. The plug connector as claimed in claim 1, wherein the protecting element is integrally molded with the front end of the combination element.

3. The plug connector as claimed in claim 1, wherein the combination element includes a connecting end and a base portion, the connecting end is connected with a front end of the base portion, the connecting end is disposed to a front end of the inner shell connected with one end of the connecting element, the connecting end is connected with the protecting element, the connecting end and the base portion are integrally molded, the base portion surrounds the front of the peripheral surface of the inner shell.

4. The plug connector as claimed in claim 3, wherein the first buckling assembly includes an upper buckling portion protruded from and projecting beyond a top surface of the connecting end, and a lower buckling portion protruded from and projecting beyond a bottom surface of the connecting end, the upper buckling portion and the lower buckling portion are buckled with the front end of the inner shell connected with the connecting element.

5. The plug connector as claimed in claim 3, wherein a middle of a front edge of a top of the inner shell is recessed rearward to form a first recess, a middle of a front edge of a bottom of the inner shell is recessed rearward to form a second recess, a top and a bottom of the connecting end are opened freely to form a first lacking groove and a second lacking groove, a rear wall of the first lacking groove extends frontward and protrudes downward to form an upper buckling portion, a rear wall of the second lacking groove extends frontward and protrudes upward to form a lower buckling portion, the upper buckling portion is buckled in the first recess, the lower buckling portion is buckled in the second recess.

6. The plug connector as claimed in claim 3, wherein the second buckling assembly is disposed to one end of the base portion adjacent to the soldering element, the second buckling assembly has a first lateral buckling portion and a second lateral buckling portion, two opposite sides of the base portion extend rearward and then protrude oppositely to form the first lateral buckling portion and the second lateral buckling portion, respectively, the first lateral buckling portion and the second lateral buckling portion project beyond a rear surface of the base portion, inner surfaces of two opposite sides of a rear end of the outer shell adjacent to the soldering element are recessed oppositely to form two buckling grooves penetrating through rear surfaces of the two opposite sides of the rear end of the outer shell, respectively, the two buckling grooves are matched with and corresponding to the first lateral buckling portion and the second lateral buckling portion, respectively, the first lateral buckling portion and the second lateral buckling portion are buckled in the two buckling grooves, respectively.

7. The plug connector as claimed in claim 1, wherein the protecting element has a hollow first frame, and a hollow second frame protruded rearward from a middle of a rear surface of the first frame, a middle of the first frame is corresponding to and communicated with a middle of the second frame, the second frame is inserted into a middle of the combination element.

8. The plug connector as claimed in claim 1, wherein the inner shell has a location function.

9. A plug connector, comprising:

a main body including a connecting element, a circuit board electrically connected with the connecting element, a soldering element soldered to a rear end of the circuit board, and an inner shell surrounding the circuit board;

a combination element surrounding the inner shell;

a protecting element integrally molded with a front end of the combination element and mounted around the inner shell; and an outer shell surrounding the inner shell, the protecting element fastened to a junction among the connecting element, the inner shell and the outer shell, the combination element having a first buckling assembly and a second buckling assembly disposed to two opposite ends of the combination element facing the protecting element and the outer shell, respectively, the first buckling assembly being buckled with the front of the peripheral surface of the inner shell, the second buckling assembly being buckled with an inner peripheral surface of the outer shell.

10. A plug connector, comprising:

a connecting element;

a circuit board electrically connected with the connecting element;

a soldering element soldered to the circuit board;

an inner shell surrounding the circuit board;

a combination element surrounding a front of a peripheral surface of the inner shell;

a protecting element integrally molded with a front end of the combination element and mounted around the front of the peripheral surface of the inner shell; and an integrally molded outer shell surrounding the inner shell, the protecting element fastened to a junction among the connecting element, the inner shell and the outer shell, the combination element having a first buckling assembly and a second buckling assembly disposed to two opposite ends of the combination element facing the protecting element and the outer shell, respectively, the first buckling assembly being buckled with the front of the peripheral surface of the inner shell, the second buckling assembly being buckled with an inner peripheral surface of the outer shell.

* * * * *